US007765624B1

(12) United States Patent
Larson et al.

(10) Patent No.: US 7,765,624 B1
(45) Date of Patent: Aug. 3, 2010

(54) SHOULDER PAD

(75) Inventors: Paul M. Larson, Bangkok (TH); Patrick J. Brassill, San Jose, CA (US); Scott M. Halstead, Knoxville, TN (US)

(73) Assignee: Adams USA, Inc., Cookeville, TN (US)

( * ) Notice: Subject to any disclaimer, the term of this patent is extended or adjusted under 35 U.S.C. 154(b) by 311 days.

(21) Appl. No.: 11/734,880

(22) Filed: Apr. 13, 2007

Related U.S. Application Data

(62) Division of application No. 10/850,322, filed on May 20, 2004, now abandoned.

(51) Int. Cl.
*A41D 27/26* (2006.01)

(52) U.S. Cl. ..... 2/459

(58) Field of Classification Search ..... 2/267, 2/268, 455, 459, 44, 45, 310, 326–328, 461, 2/259; 224/264–265, 201
See application file for complete search history.

(56) References Cited

U.S. PATENT DOCUMENTS

| | | | |
|---|---|---|---|
| 2,163,463 | A | 6/1939 | Kennedy |
| 2,741,767 | A | 4/1956 | Weeks |
| 3,366,970 | A | 2/1968 | Morgan |
| 3,431,560 | A | 3/1969 | Austin |
| 3,721,992 | A | 3/1973 | Ettinger |
| 3,739,397 | A | 6/1973 | Truelove |
| 3,740,762 | A | 6/1973 | Truelove |
| 3,740,763 | A | 6/1973 | Mitchell |
| 3,867,726 | A | 2/1975 | Owl et al. |
| 3,981,027 | A | 9/1976 | Anderson |
| 4,135,252 | A | 1/1979 | Latina et al. |
| 4,158,242 | A | 6/1979 | Mitchell |
| 4,295,227 | A | 10/1981 | Mitchell |
| 4,320,537 | A | 3/1982 | Mitchell |
| 4,322,859 | A | 4/1982 | Mitchell |
| 4,435,851 | A | 3/1984 | Mitchell et al. |
| 4,467,475 | A | 8/1984 | Gregory et al. |
| 4,516,273 | A | 5/1985 | Gregory et al. |
| 4,547,905 | A | 10/1985 | LaPorta, Jr. |
| 4,554,681 | A | 11/1985 | Kirkland |
| 4,590,621 | A | 5/1986 | Flosi et al. |
| 4,610,035 | A | 9/1986 | Mattila |
| 4,675,912 | A | 6/1987 | Kirkland |
| 4,679,253 | A | 7/1987 | Mitchell et al. |
| 4,680,814 | A | 7/1987 | Mitchell et al. |
| 4,694,505 | A | 9/1987 | Flosi et al. |
| 4,698,845 | A | 10/1987 | Cosby |
| 4,715,066 | A | 12/1987 | Mitchell et al. |
| 4,868,925 | A | 9/1989 | Mitchell |

(Continued)

OTHER PUBLICATIONS

Color copies (Exhibit A, 6 pages).

(Continued)

*Primary Examiner*—Tejash Patel
(74) *Attorney, Agent, or Firm*—Luedeka, Neely & Graham, PC

(57) ABSTRACT

An epaulet system for shoulder pads, the system including an epaulet having an elongate epaulet projection extending outwardly therefrom, an epaulet restraining member having an elongate channel for receiving the epaulet projection, a flexible connector hingedly connecting the epaulet to the shoulder pad, and a force member for urging the epaulet toward the shoulder pad.

6 Claims, 12 Drawing Sheets

U.S. PATENT DOCUMENTS

| | | | |
|---|---|---|---|
| 4,872,216 | A | 10/1989 | Wingo, Jr. |
| 4,926,503 | A | 5/1990 | Wingo, Jr. |
| 4,985,931 | A | 1/1991 | Wingo, Jr. |
| 4,989,265 | A | 2/1991 | Nipper et al. |
| 5,029,341 | A | 7/1991 | Wingo, Jr. |
| 5,060,313 | A | 10/1991 | Neuhalfen |
| 5,129,101 | A | 7/1992 | Douglas |
| 5,173,964 | A | 12/1992 | Ball et al. |
| 5,187,812 | A | 2/1993 | Neuhalfen |
| 5,237,704 | A | 8/1993 | Phippen |
| 5,390,368 | A | 2/1995 | Chang |
| 6,079,056 | A | 6/2000 | Fogelberg |
| 6,553,579 | B1 | 4/2003 | Gillen et al. |

OTHER PUBLICATIONS

Color copies (Exhibit B, 4 pages).
Color copies (Exhibit C, 4 pages).

SHOULDER PAD

CROSS-REFERENCE TO RELATED APPLICATION

This application is a divisional of application Ser. No. 10/850,322, filed May 20, 2004 now abandoned, and entitled SHOULDER PAD.

FIELD OF THE INVENTION

This invention relates generally to protective equipment. More particularly, this invention relates to shoulder pads, particularly shoulder pads suitable for the sport of football.

BACKGROUND AND SUMMARY OF THE INVENTION

Improvement is desired in the construction of football shoulder pads. In particular, improvement is desired in the provision of epaulets. Epaulets are components of a shoulder pad located to protect the end portions of the shoulder. The construction of conventional shoulder pads undesirably restricts range of motion of the user and have other undesirable performance characteristics.

The present invention relates to an improved shoulder pad construction that is lightweight and which enables improved range of motion for a player. Shoulder pads according to the invention also enable improved energy transfer and control over movement of components of the pad during impact.

With regard to the foregoing, the present invention is directed to an epaulet system for a shoulder pad. In a preferred embodiment, the system includes an epaulet having an elongate epaulet projection extending outwardly therefrom, an epaulet restraining member having an elongate channel for receiving the epaulet projection, a flexible connector hingedly connecting the epaulet to the shoulder pad, and a force member for urging the epaulet toward the shoulder pad.

In another aspect, the invention relates to a shoulder pad, including, an arch member and an epaulet system connected to the arch member. The epaulet system preferably includes an epaulet having an epaulet projection extending outwardly therefrom and an epaulet restraining member mounted on the arch member having a channel for receiving the epaulet projection. A flexible connector hingedly connects a portion of the epaulet and a portion of the arch member and a force member urges the epaulet toward the shoulder pad.

BRIEF DESCRIPTION OF THE DRAWINGS

Further features of preferred embodiments of the invention will become apparent by reference to the detailed description of preferred embodiments when considered in conjunction with the figures, wherein like reference numbers, indicate like elements through the several views, and wherein.

DETAILED DESCRIPTION

Figure 1A:
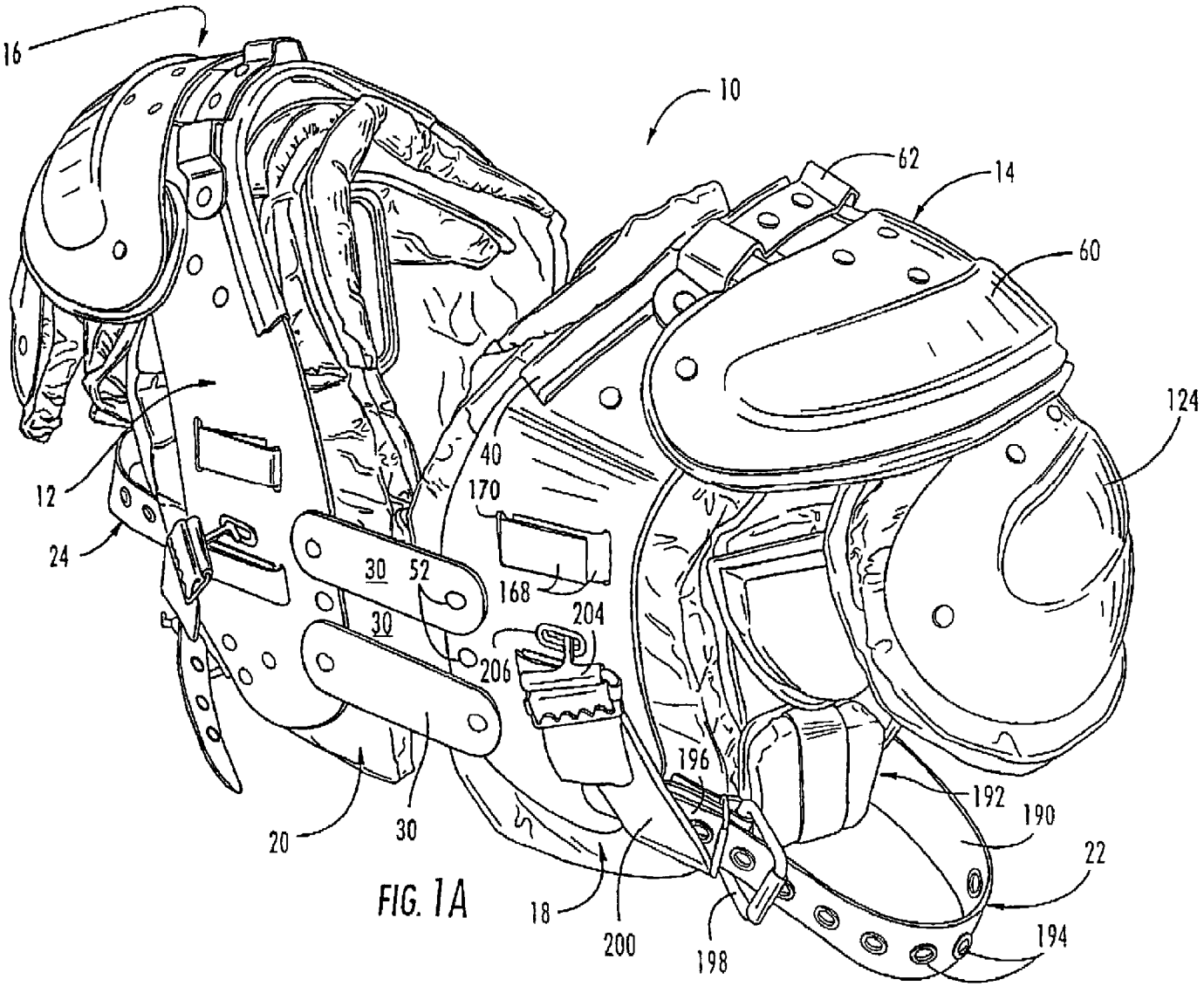
FIG. 1A is a front perspective view of a preferred embodiment of a shoulder pad in accordance with a preferred embodiment thereof.
Figure 1B:
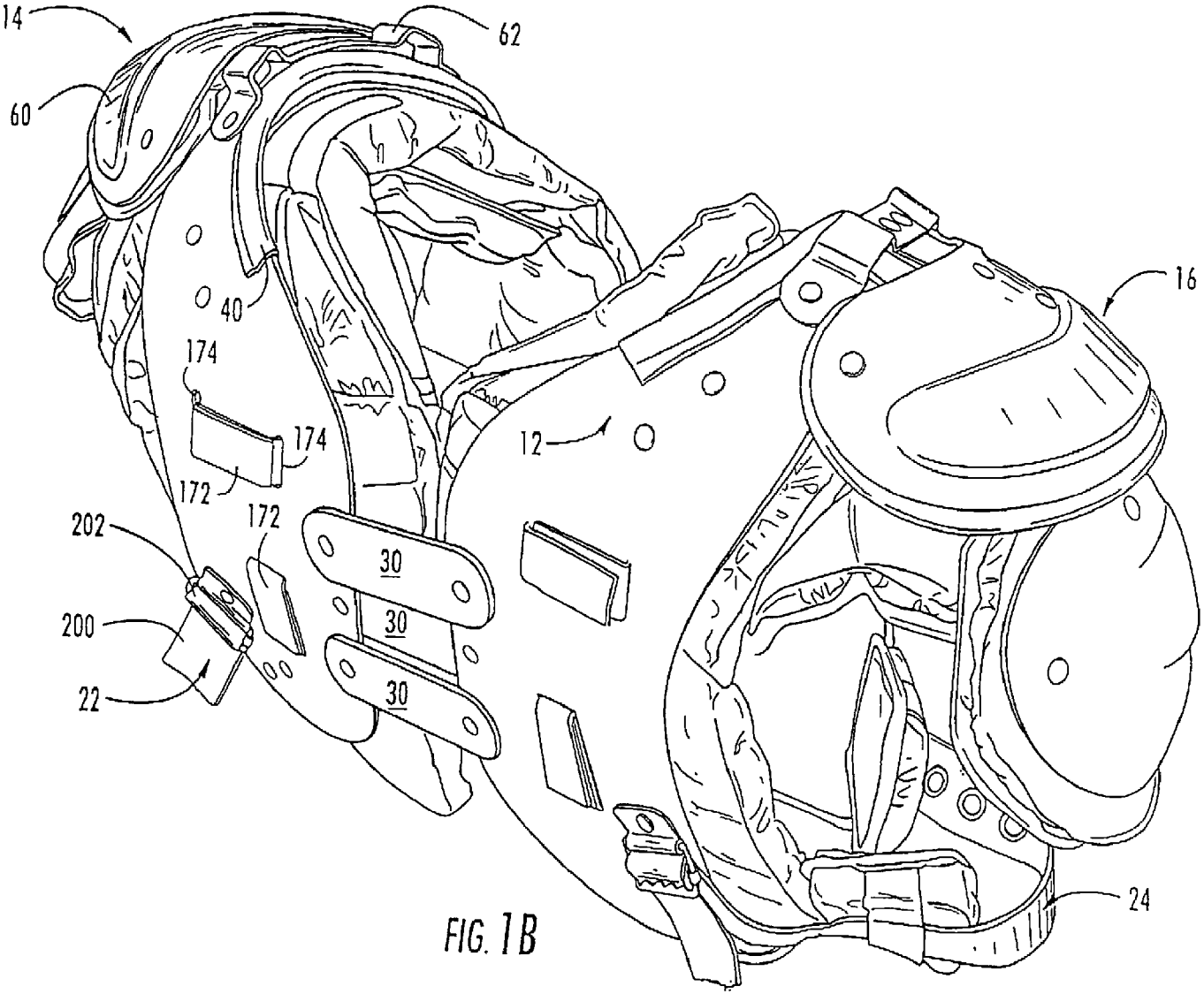
FIG. 1B is a rear perspective view thereof.
Figure 2:
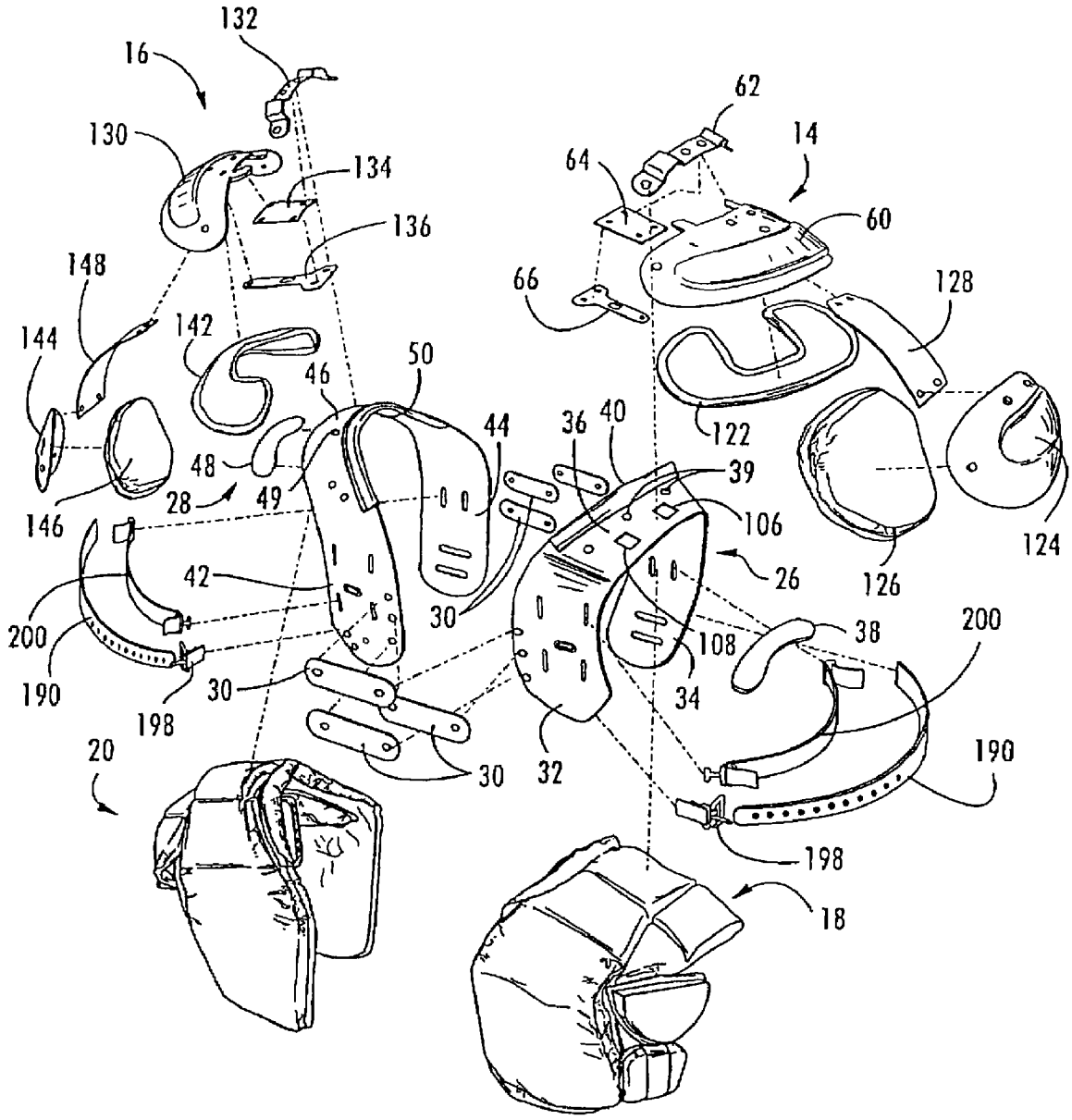
FIG. 2 is an exploded perspective view of the shoulder pad assembly of FIGS. 1A and 1B.

With initial reference to FIGS. 1A-2, the invention relates to a shoulder pad 10 including an arch assembly 12, a pair of epaulet systems 14 and 16, a pair of pad assemblies 18 and 20, and a pair of strap systems 22 and 24.

Arch Assembly

The arch assembly 12 includes arch members 26 and 28, and a plurality of arch member connectors 30. The arch member 26 is generally U-shaped in configuration and preferably of one-piece molded plastic construction, with a substantially uniform thickness of from about 1/16 to about 3/16 inch (1.6 to about 4.7 mm), most preferably about 1/8 inch or slightly greater (3.2 mm-3.8 mm). A preferred plastic material is polyethylene. The arch member 26 is preferably configured to include a chest portion 32, a back portion 34, and a connecting portion 36.

The chest portion 32 is configured to be substantially flat for positioning adjacent the chest of a user, preferably having a width of from about 4 to about 5 inches, depending upon the size of the user. The back portion 34 is configured to be substantially flat for positioning adjacent the back of a user, preferably having a width that is about one-half inch greater than the width of the chest portion 32.

The connecting portion 36 extends between the chest portion 32 and the back portion 34. The connecting portion 36 positions the chest portion 32 and the back portion 34 in a substantially spaced apart and facing relationship. The connecting portion 36 preferably has a width of from about 1 to about 2 inches, most preferably about 1½ inches. The connecting portion 36 fits over the shoulder of the user. In this regard, the length and curvature of the connecting portion 36 is selected to fit over the shoulder of the user and provide a desired spacing of the chest portion 32 and the back portion 34 corresponding to the size of the player, with such spacing preferably being from about 11 to about 14 inches.

The connecting portion is preferably relatively narrow so as to avoid restriction of mobility of a user. In this regard, and as explained more fully below, it is noted that the epaulet system 14 cooperates with the connecting portion 36 to offer protection to a user, yet provide more freedom of movement as compared to conventional epaulet/arch structures.

If desired, a stiffener 38, such as a plastic segment made of a stiffer plastic material than the arch member 26, may preferably be attached to the underside of the connecting portion 36 as by fasteners 39, such as screws, rivets, or the like. Also, padding 40 may desirably be secured, as by stitches, along the interior edge of the arch member 26 to pad the neck of the user.

The arch member 28 is substantially similar to the member 26, but is configured for positioning on the opposite side of the neck of the user from the arch member 26. Accordingly, the arch member 28 includes a chest portion 42, a back portion 44, a connecting portion 46, stiffener 48, fasteners 49, and padding 50 corresponding to the chest portion 32, back portion 34, connecting portion 36, stiffener 38, fasteners 39, and padding 40 of the arch member 26.

Each connector 30 is preferably a substantially rectangular member having rounded ends. Each connector 30 is preferably made of the same plastic material as the arch members 26 and 28 and has a width of from about 1 to about 2 inches and a length of from about 4 to about 5 inches, with the length selected to conform to the desired spacing of the arch members 26 and 28.

The arch assembly 12 is preferably assembled as by placing the arch members 26 and 28 adjacent to one another a desired distance apart, with the chest portion 32 substantially parallel to the chest portion 42. A plurality of the connectors 30, preferably three as shown, are used to span between and connect the chest portions 32 and 42, with one end of each connector 30 being pivotally connected to the chest portion 32 as by a fastener 52, such as a rivet, and the other end of the connector 30 being pivotally connected to the chest portion 42 in a similar manner. Preferably, two connectors 30 are spaced apart and located adjacent the exterior of the chest portion 32 and the chest portion 42, with another of the connectors 30 located between the two connectors 30 and adjacent the interior of the chest portion 32 and the chest portion 42. In a similar manner, the back portions 34 and 44 are connected using a plurality of the connectors 30. This construction advantageously enables the arch members 26 and 28 to swivel or otherwise move relative to and independent to one another and remain desirably situated on a user during movement, such as when raising or lowering the arms or otherwise changing the orientation of the arms and shoulders.

Epaulet Systems

With reference to FIGS. 3A-6D, the epaulet system 14 preferably includes as its primary components an epaulet 60, an epaulet restraining member 62 or 62', a flexible connector 64, and a force member 66.

Figure 5A:
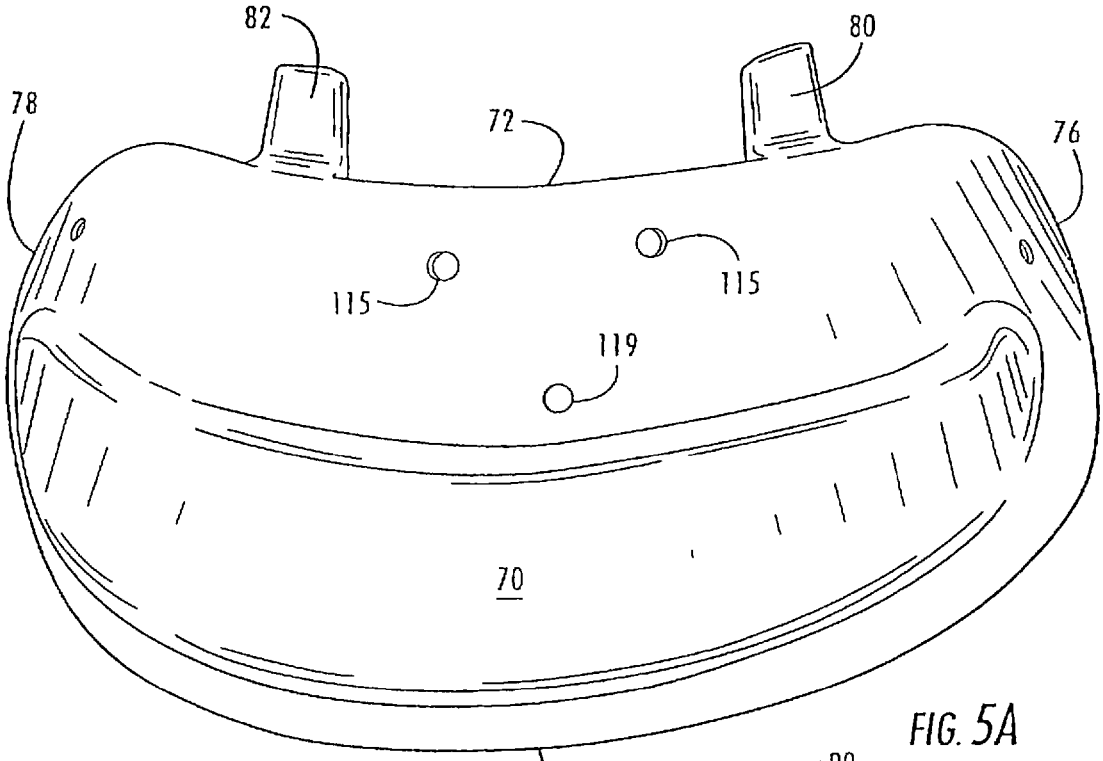
FIGS. 5A-5B are top and bottom plan views, respectively, of an epaulet member component of the epaulet system of FIG. 4.
Figure 5B:
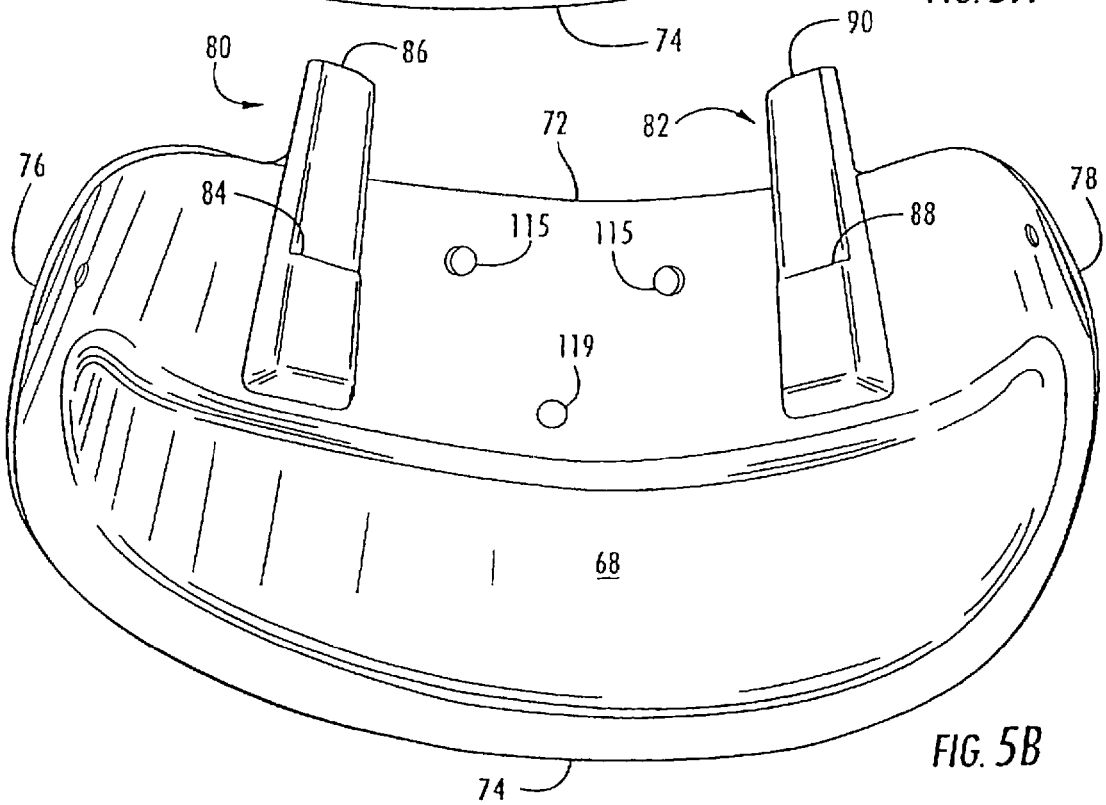

With additional reference to FIGS. 5A and 5B, the epaulet 60 is preferably of one-piece molded plastic construction having a generally convex shape so as to be positionable to overlie the shoulder of a user. The epaulet 60 includes an inner surface 68, an opposite outer surface 70, an inner end 72, an outer end 74, sides 76 and 78, and projections 80 and 82. The projections 80 and 82 are substantially rigid and preferably extend away from the inner end 72 and are preferably substantially parallel and spaced apart about 3 inches apart. The portion of each projection 80 and 82 that extends from the inner end 72 preferably has a length of about 1 inch, a width of about ½ inch, and a thickness of about ¼ inch.

With reference to FIG. 5B, the overall length of the projection 80 is preferably about 2.5 inches, with a thickened portion or shoulder 84 beginning about 1 inch from end 86. The projection 82 is similar in configuration and includes a shoulder 88 located in the same manner from end 90.

The epaulet restraining member 62 is mounted to the connecting portion 36 of the arch member 26 and engages portions of the projection 80 or the projection 82 or both the projections 80 and 82 of the epaulet 60 when the epaulet 60 is urged in various directions such as when acted upon by an external force or impact during contact in the sport of Football to restrain movement of the epaulet 60. Portions of the inner end 72 of the epaulet 60 adjacent the projections 80 and 82 may also contact portions of the restraining member 62 during an impact.

The epaulet restraining member 62 is preferably an elongate generally curved member that is substantially rigid, and of one-piece molded plastic construction. The member 62 preferably defines a pair of ends 92 and 94, and a middle portion 96 configured to lie flat against the connecting portion 36 of the arch member 26. In this regard, apertures 98 preferably extend through the ends 92 and 94 and the middle portion 96 for passage of fasteners 100, such as rivets, screws, or the like for attaching the member 62 to the arch member 26.

Channels 102 and 104 are defined on opposite sides of the middle portion 96 and spaced corresponding to the spacing between the projections 80 and 82 for receiving the projections 80 and 82. The epaulet restraining member 62 preferably has an overall length of about 6 inches and a substantially uniform width of about ¾ inch. The channels 102 and 104 are each preferably configured to define a channel having a span of about ¾ inch and a depth of about ¼ inch.

Figure 6A:
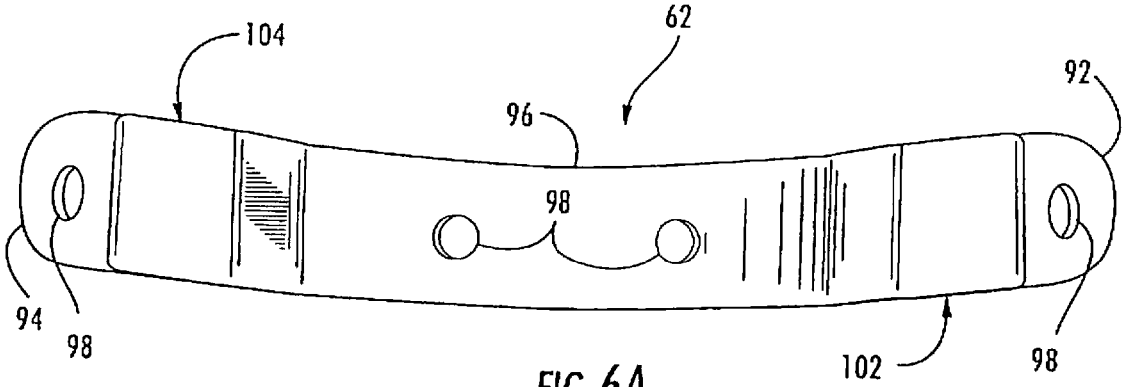
FIGS. 6A-6B are top and bottom plan views, respectively, of a locking plate component of the epaulet system of FIG. 4.
Figure 6B:
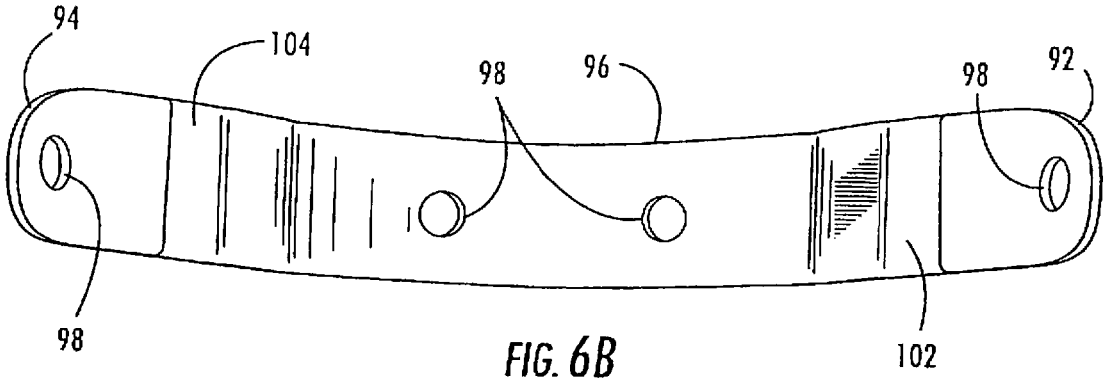
Figure 6C:
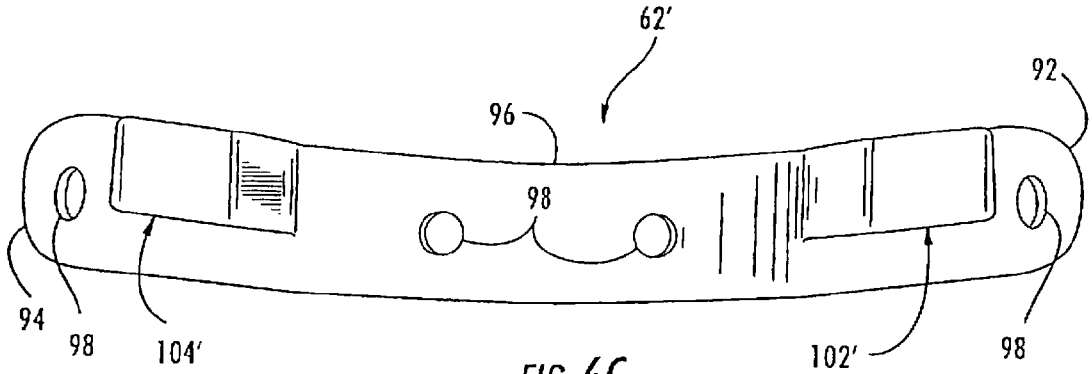
FIGS. 6C-6D are top and bottom plan views, respectively, of an alternate embodiment of a locking plate component.
Figure 6D:
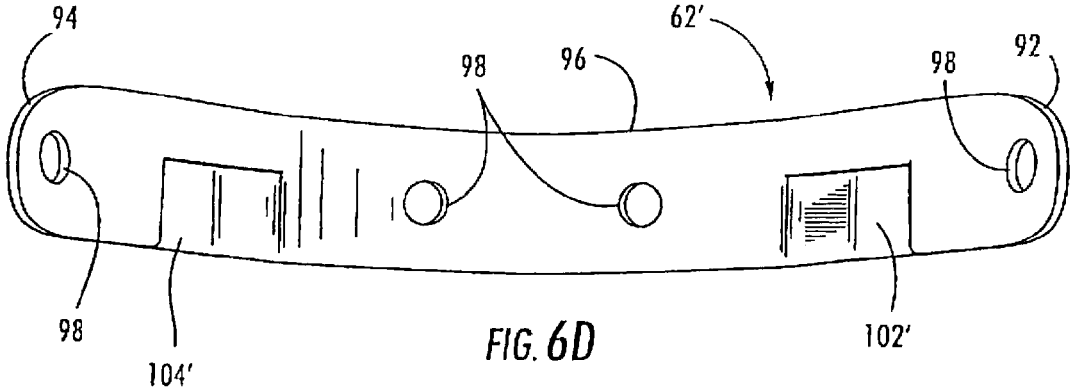
Figure 7:
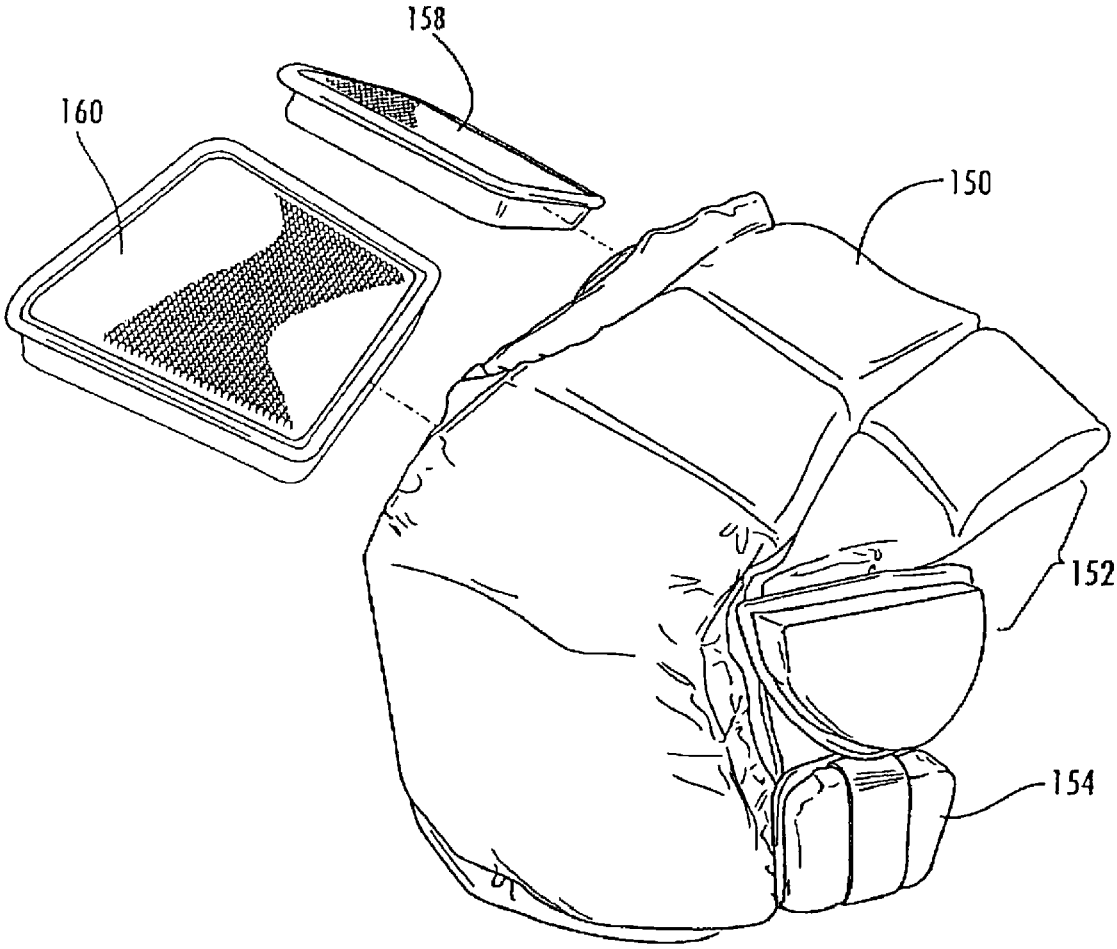
FIG. 7 is an exploded perspective view of a portion of a pad assembly of the shoulder pad of FIGS. 1A-1B.
Figure 8:
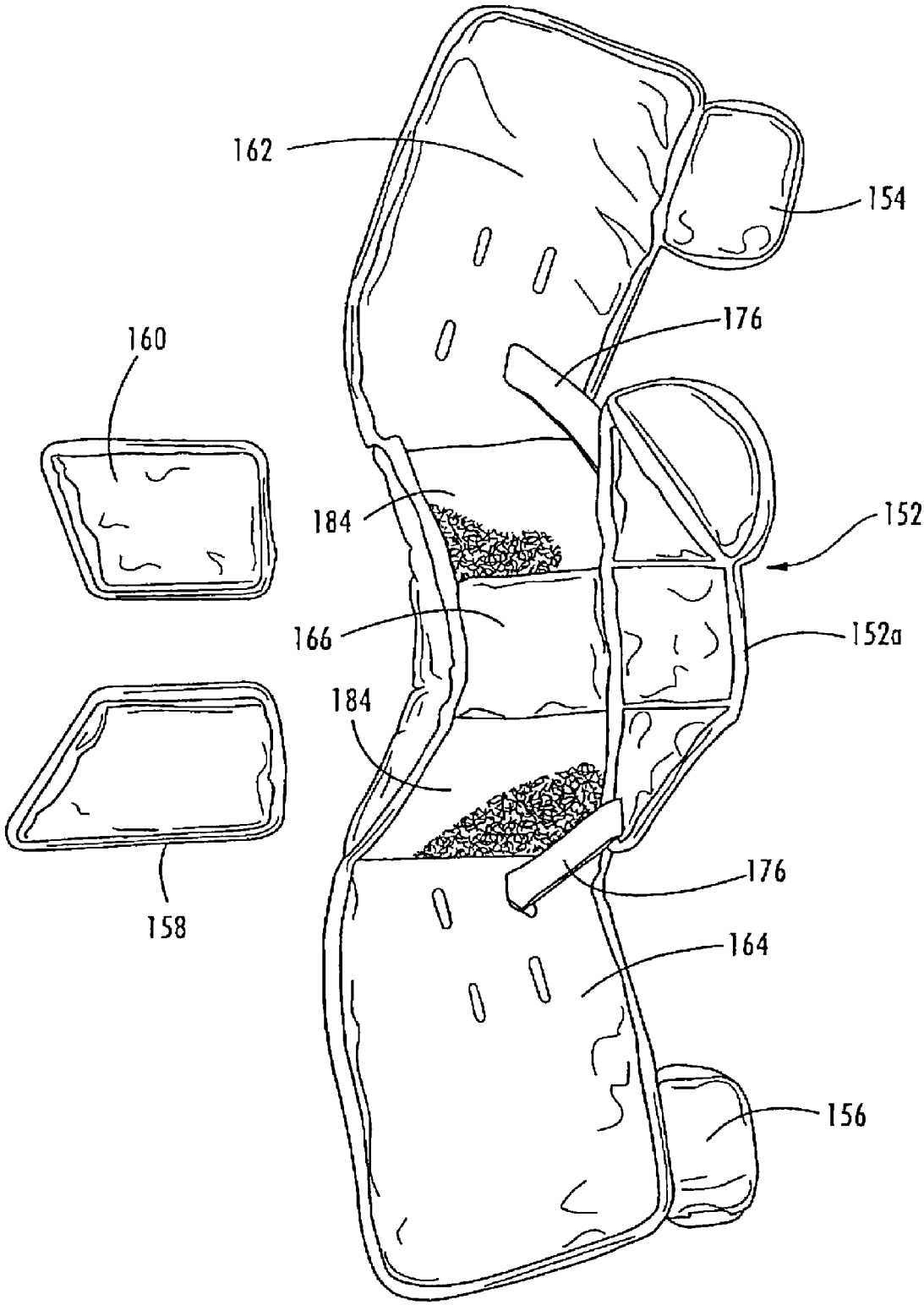
FIG. 8 is a bottom plan view of the pad assembly of FIG. 7.
Figure 9:
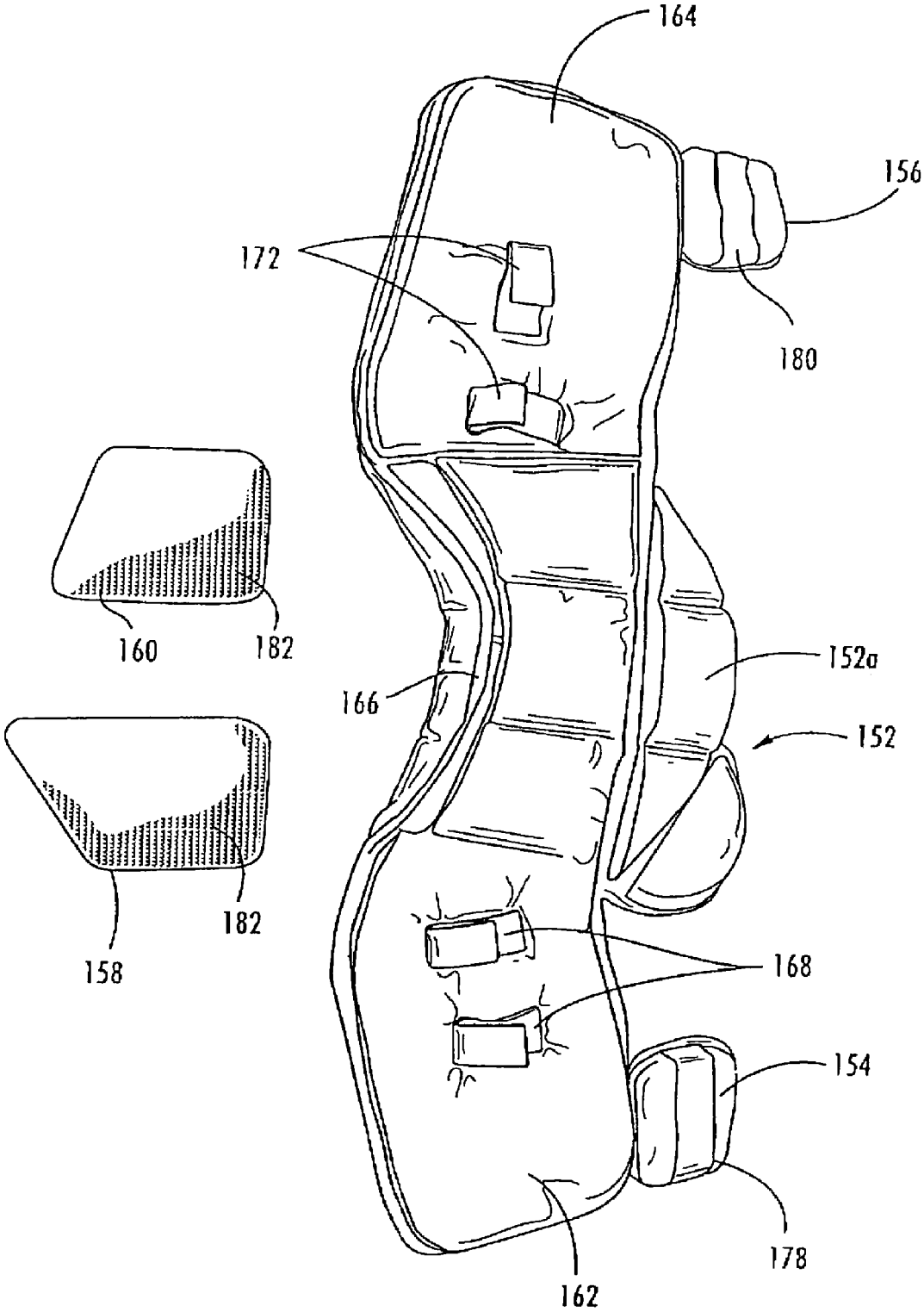
FIG. 9 is a top plan view of the pad assembly of FIG. 7.

With reference to FIGS. 6C-6D, there is shown an alternate embodiment of a restraining member 62'. The restraining member 62' is preferably identical to the member 62, except that channels 102' and 104' thereof are blind channels and do not pass all the way through to the interior/medial plane. The ends 86 and 90 of the projections 80 and 82 will preferably make contact with the terminal ends of the channels 102' and 104', respectively, when the epaulet 60 is in its normal, generally horizontal position. In one aspect, this desirably provides a positive limit of movement of the epaulet 60 in a direction toward the neck of the user.

Figure 3A:
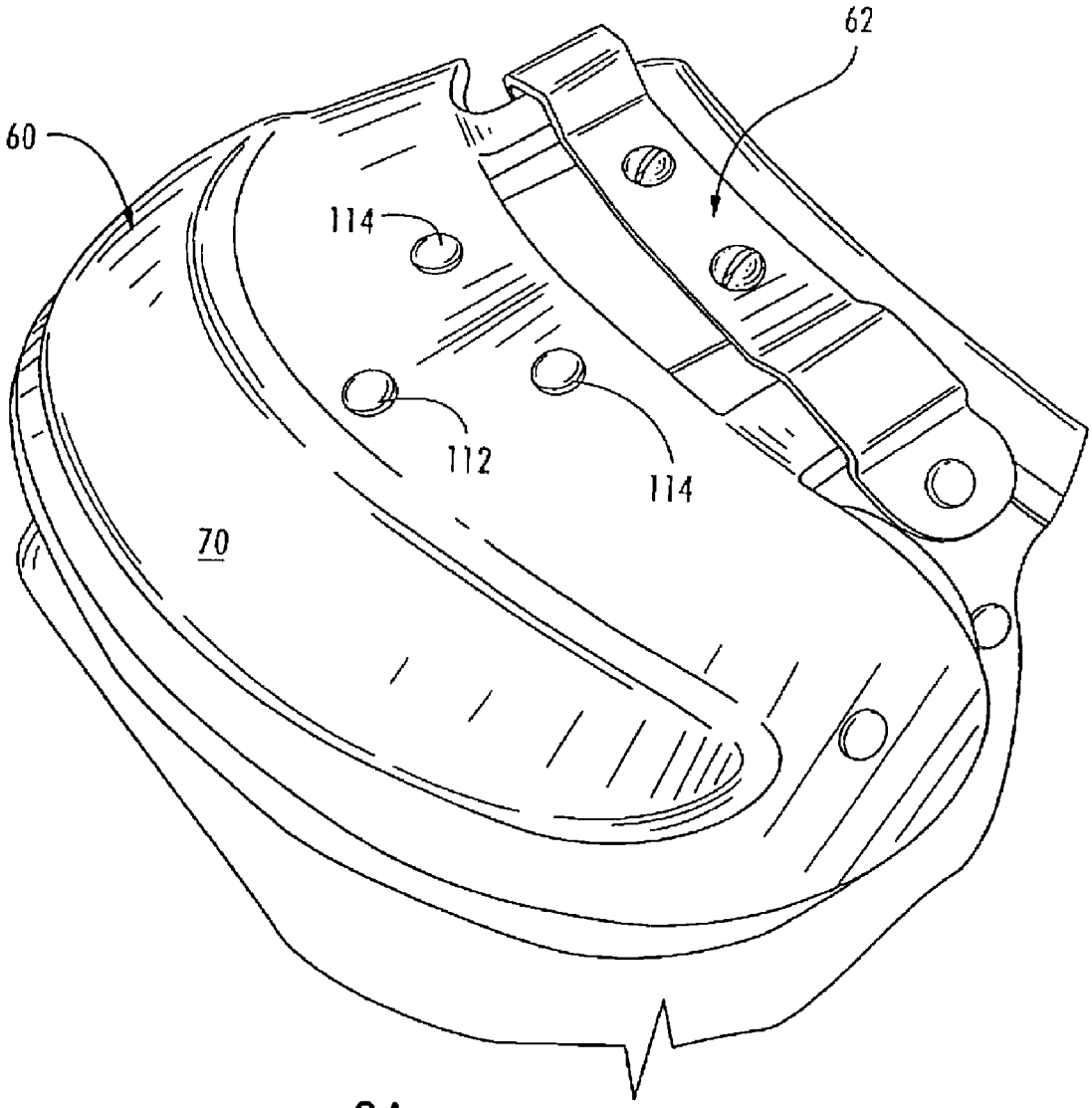
FIGS. 3A-3C are perspective views of an epaulet system of the shoulder pad of FIGS. 1A-1B.
Figure 3B:
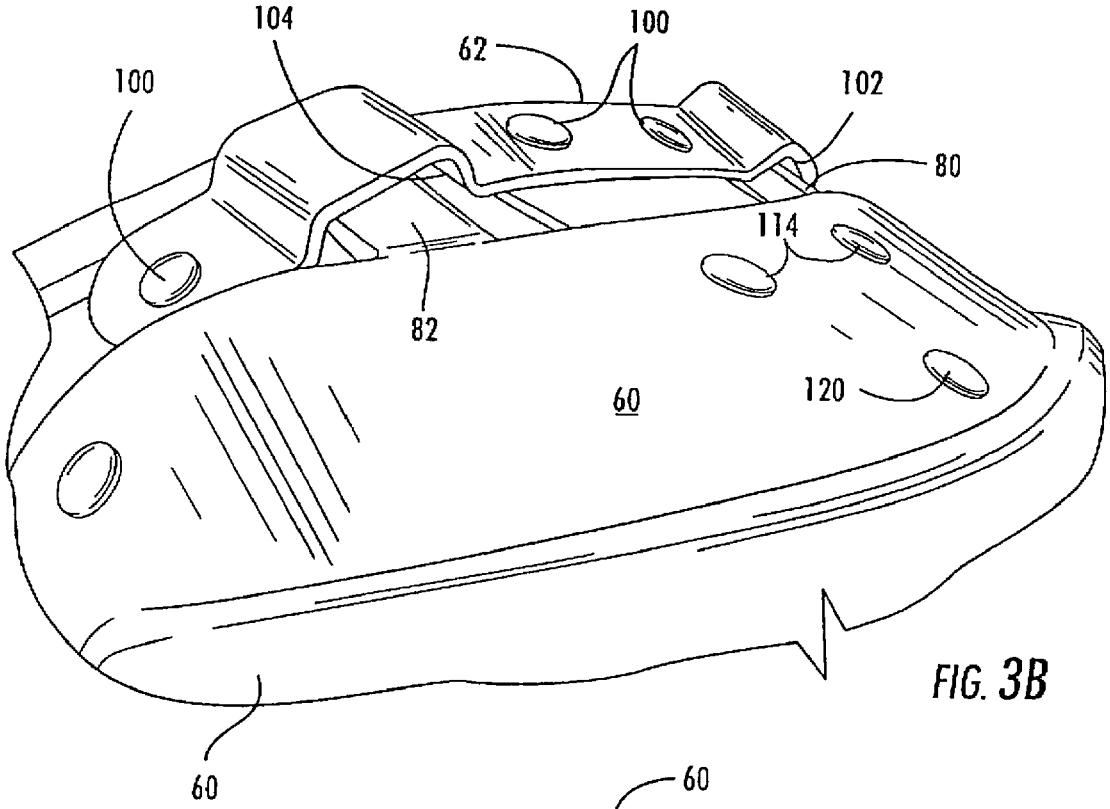
Figure 3C:
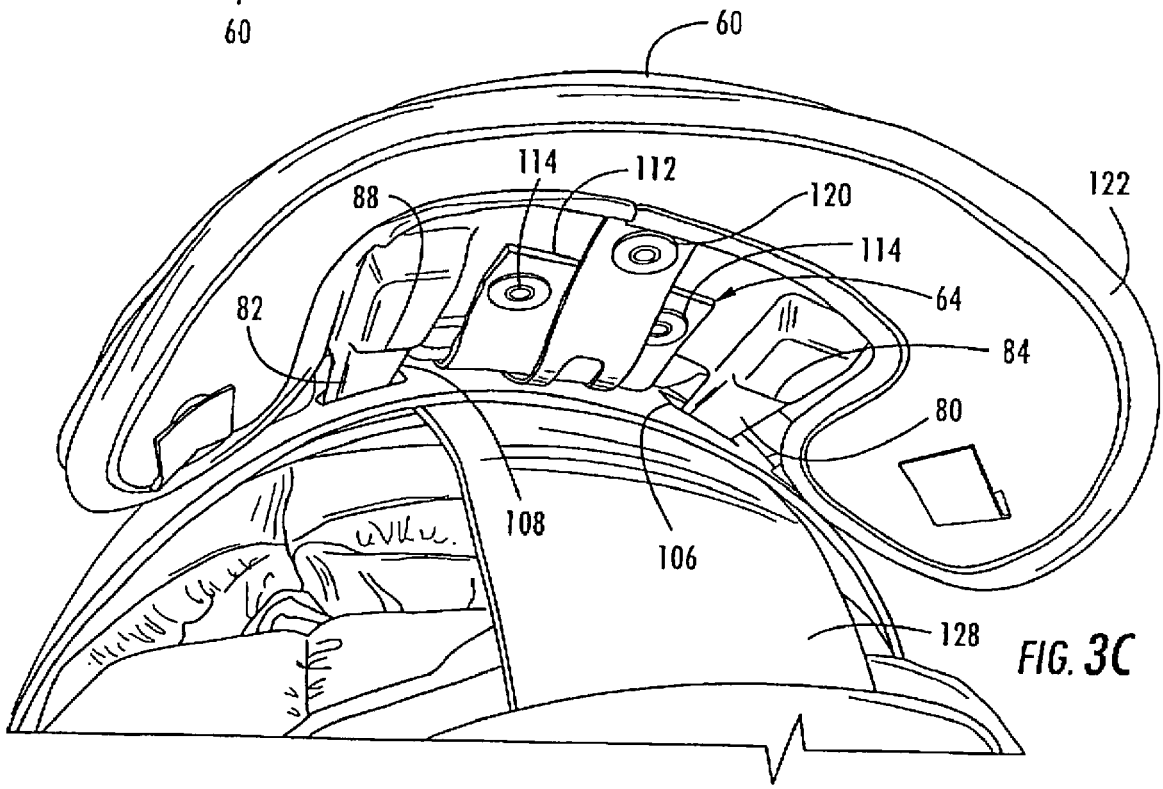
Figure 4:
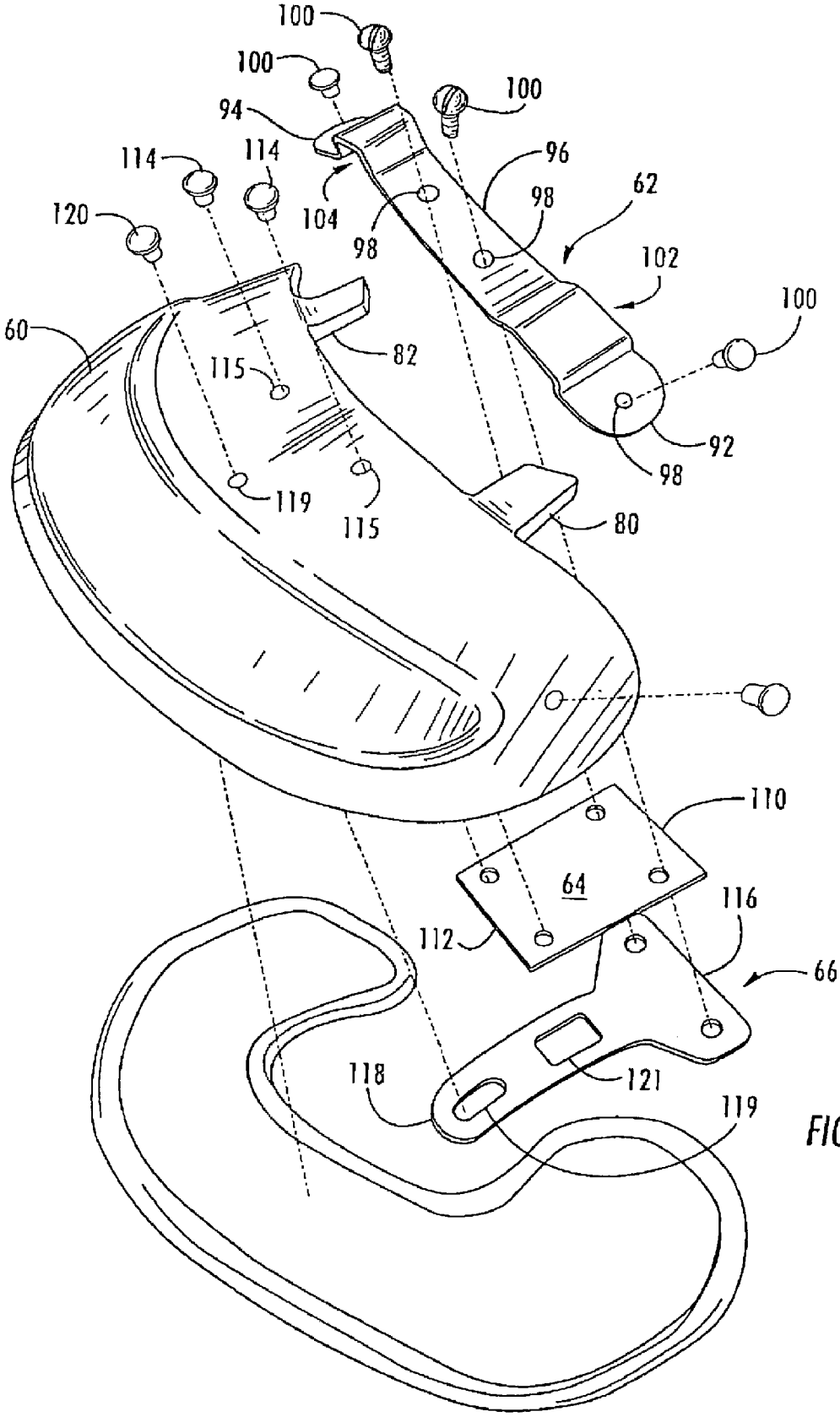
FIG. 4 is an exploded perspective view of the epaulet system of FIGS. 3A-3C.

The channels 102 and 104 (and 102' and 104') are preferably positioned directly over correspondingly sized and spaced apertures 106 and 108 defined through the connecting portion 36 of the arch member 26 (FIG. 3C). The apertures 106 and 108 provide open areas into which the projections 80 and 82 may pass such as when the position of the epaulet 60 is changed, such as when a user raises an arm. That is, as the epaulet pivots to a raised position, the projections 80 and 82 pivot toward the arch member 26, with the upper surfaces of the projections 80 and 82 contacting anterior portions of the epaulet restraining member 62 (or 62') to limit movement of the epaulet 60, including movement in a direction generally toward the neck of the user.

The apertures 106 and 108 on the arch member 26 are sized, positioned, and configured to provide sufficient clearance for the projections 80 and 82 such that the arch member 26 does not interfere with the movement of the epaulet 60. In addition, it will be appreciated that the shoulders 84 and 88 of the projections 80 and 82 contact edges of the apertures 106 and 108 to prevent undesired movement of the epaulet.

Returning to FIG. 4, the flexible connector 64 is preferably a substantially rectangular strip of a flexible polymeric material such as vinyl or plastic coated webbing. The connector 64 preferably has a length of about 2½ inches, a width of about 2 inches, and a thickness of about ⅛ inch. An end 110 of the connector 64 is preferably received under the middle portion 96 of the restraining member 62 such that the fasteners 100 extend through the end 110 to secure it in position, with corresponding apertures preferably being preformed through the end 110 (FIGS. 3A-3*b*). Opposite end 112 of the connector 64 is secured to inner surface 68 of the epaulet 60 as by fasteners 114 such as screws, rivets, or the like which pass through apertures 115. The flexible connector 64 serves as a hinge to permit the epaulet 60 to be pivoted upwardly from the arch member 26 such as when an arm of a user is raised.

The force member 66 is preferably an elongate strip of spring steel which is preferably located to underlie the flexible connector 64. When deformed, such as when the user raises an arm, the force member 66 urges the epaulet 60 downwardly so that the epaulet 60 quickly returns and preferably springs back to an orientation overlying the arch member 26, when the arm of the user lowered from a raised position. An end 116 of the force member 66 is preferably received under the flexible connector 64 and the middle portion 96 such that the fasteners 100 extend through apertures of the end 112 to secure it in position.

Opposite end 118 of the member 66 is preferably secured to inner surface 68 of the epaulet 60 as by a fastener 120 such as a screw, rivet, or other structure, passing through an aperture 119 of the epaulet 60, preferably a slot-shaped aperture. The fastener 120 is preferably movable within the confines of the aperture 119 so as to enable the epaulet 60 to travel substantially through an arc motion, with the limits of the motion of the epaulet controlled by the force member 66 and the restraining member 62 (or 62') so as to avoid undesirable motion of the epaulet, such as movement in a direction generally toward the neck of the user. The force member 66 and the restraining member 62 (or 62') also advantageously cooperate to control lateral rotational movement of the epaulet, and thereby further limiting undesirable movement of the epaulet 60. Apertures, such as an aperture 121 may be defined through the force member 66 to inhibit creasing thereof during flexure thereof.

It will be noted that the connecting portion 36 of the arch member 26 and the epaulet system 14 advantageously cooperate to provide a relatively large area of protection, yet without unduly limiting the mobility of a user. For example, it is preferred that the connecting portion 36 is relatively narrow, e.g., between about 1 and 2 inches, so as to avoid having restrictive structure over the shoulder. The epaulet system 14 is configured to extend from the connecting portion 36 so as to provide protective structure, yet move with the user so as to not restrict the user. That is, the epaulet system functions as an extension of the arch that is movable as needed to accommodate motion of the user.

In this regard, and returning to FIG. 2, the epaulet system 14 may also preferably include an epaulet pad 122, an end cap 124, an end cap pad 126, and an end cap connector 128. This structure further enhances protection, but without significantly restricting mobility of the user. The epaulet pad 122 is preferably attached to the inner surface 68 of the epaulet 60. The end cap pad 126 is attached to an inner surface of the end cap 124, with the end cap 124 connected to the connecting portion 36 of the arch member 26 by the connector 128 so as to be lie outwardly from the epaulet 60. The connector 128 preferably substantially corresponds to the flexible connector 64, but has a longer length of about 6 inches.

The epaulet system 16 is preferably identical to the epaulet system 14 and is mounted on the arch member 28. Accordingly, the epaulet system 16 includes epaulet 130, an epaulet restraining member 132, a flexible connector 134, and a force member 136, corresponding to the epaulet 60, epaulet restraining member 62, flexible connector 64, and force member 66 of the epaulet system 14. The epaulet system 16 may likewise include an epaulet pad 142, an end cap 144, an end cap pad 146, and an end cap connector 148, corresponding to the epaulet pad 122, end cap 124, end cap pad 126, and end cap connector 128 of the epaulet system 14.

The epaulet systems 14, 16 and the cooperating arch assemblies 26 and 28 are configured to transfer energy, such as experienced during contact in the sport of Football, from the epaulet systems to the arch assemblies. It is believed that the energy transferred to the arch assembly dissipates over the larger surface area of the arch assembly and is transferred away from the shoulder of the user and spread over portions of the chest and back of the user.

The epaulet systems and the arch assemblies also cooperate to enable improved range of motion of the arm and shoulder of the user without compromising protective coverage of the user. For example, it has been observed that the structure provided by the epaulet systems and the arch assemblies cooperate to permit relative movement of portions of the epaulet system and to enable the epaulet system to be positioned in various raised and/or angular orientations.

This is advantageous to enable improved movement of the arm, such as raising the arm of the user over the head of the user, as compared to conventional shoulder pads. Furthermore, when the arm is lowered from a raised position, the epaulet system 14 functions to return quickly to a lowered orientation. Thus, as described above, the epaulet system functions as an extension of the arch that is movable as needed to accommodate motion of the user.

Pad Assemblies

With reference to FIGS. 2 and 7-9, the pad assembly 18 preferably includes an elongate, preferably one-piece, body portion 150. A central extension 152, a front extension 154, and a back extension 156 are preferably joined to the body portion 150 as by stitches. A pair of fit pads 158 and 160 are preferably releasably engageable with the body portion 152.

The body portion 150 is preferably made of a flexible padding material, such as open and/or closed cell foams sandwiched between sheets of a fabric material such as water resistant taffeta. The body portion 150 is configured to correspond in shape to underlie the arch member 26 and includes a chest portion 162, a back portion 164, and a connecting portion 166 configured to underlie the chest portion 32, back portion 34, and connecting portion 36 of the arch member 26, respectively. The widths of the chest portion 162, back portion 164, and the connecting portion 166 are preferably slightly greater than the widths of the chest portion 32, back portion 34, and connecting portion 36 of the arch member 26, most preferably about 3 inches greater in width so as to extend outwardly from each edge by about 1½ inch when mounted to the arch member 26.

Straps 168 having matingly engageable hook and loop material on respective surfaces thereof are provided on the chest portion 162 for passing through corresponding apertures 170 on the chest portion 32 of the arch member 26. Likewise, straps 172 having matingly engageable hook and loop material on respective surfaces thereof are provided on the back portion 164 for passing through corresponding apertures 174 on the back portion 34 of the arch member 26. As seen in FIGS. 1A and 1B, the straps 168, 172 are passed through the apertures 170, 174 for securing the pad assembly 18 to the arch member 26.

The central extension 152 is located and configured to underlie the epaulet system 14 and is preferably made of the same materials as the body portion 152. A mid-portion **152*a* of the central extension 152 is joined to the outer edge of the connecting portion 166 as by stitches, with the remaining length of the central extension on either side of the mid portion 152*a* not being attached to the connecting portion 166 of the body portion 150**.

For example, the central extension 152 preferably has an overall edge length of about 12 inches, with the mid-portion **152*a* having a length of about 4 inches and representing the only portion of the edge length that is joined to the connecting portion 166 as by stitches. This manner of partial connection desirably enables freedom of movement so as to avoid restriction of the range of motion of a user and to cooperate with the epaulet system 14. Thus, when the epaulet system 14 is raised or moved in response to a player raising or otherwise moving an arm, the mid-portion 152*a*** moves relatively freely so as to not encumber the motion of the arm.

In this regard, a pair of elastic straps 176 preferably extend between the opposite ends of the underside of the mid-portion 152*a* and the body portion 150. The straps 176 become slightly tensioned when the mid-portion 152*a* moves to a raised or different angular orientation, such as when a user's arm is raised, or otherwise moved angularly, such that when the arm of the user is lowered or returned to its initial position the tension serves to be released to return the mid-portion 152*a* to a lowered or moved to its initial orientation.

The front extension 154 and the back extension 156 are preferably made of materials similar to that of the body portion 150 and are positioned so as to be located adjacent the side of the user when the shoulder pad 10 is worn. A strap 178 is preferably positioned adjacent the exterior of the front extension 154 and the ends of the strap 178 attached to the sides of the front extension 154 to provide a channel for receiving a portion of the strap system 22. A strap 180 is similarly configured with the back extension 156.

The fit pads 158 and 160 are preferably of similar construction to the body portion 150 and further include a hook material 182 on a surface thereof for releasably and matingly engaging corresponding loop materials 184 located on an under surface of the connecting portion 166 of the body portion 150. Thus, the fit pads 158 and 160 may be readily removed, added, or otherwise positioned for enhancing fit and comfort. In this regard, it is preferred to have the fit pads 158 and 160 provided in a variety of thicknesses to facilitate this aspect of the shoulder pad 10. If desired, additional component pads similar to the fit pads 158 and 160 may be releasably attachable to the upper surfaces of the body portion 150 or the underside of the arch member to provide further adjustablility.

The pad assembly 20 is preferably substantially identical in construction to the pad assembly 18, and is configured for installation on the arch assembly 28.

Strap Systems

The strap system 22 is configured for maintaining the shoulder pad 10 on the body of the user during activity, such as playing the sport of Football. The strap system 22 preferably includes a belt 190 having a first end 192 attached, as by rivets or other fasteners, to a lower region of the back portion 34 of the arch member 26. The belt 190 includes apertures 194 along its length, terminating at a second end 196. A buckle portion 198 is similarly attached to a lower region of the chest portion 32 of the arch member 26. The second end 196 of the belt 190 is passed through the buckle portion 198, with the buckle portion 198 adjustably engaging a desired one of the apertures 194 for cinching the belt 190 to a desired tightness.

The strap system 22 may further include an elastic strap 200, one end of which is attached to the back portion 34 of the arch member 26, as by an adjustable cinch clasp 202 attached to the back portion 34 as by rivets or other fasteners. The other end of the strap 200 is adjustably received by a T-buckle 204 which may be received by a corresponding receiver 206 provided on the chest portion 32 of the arch member 26.

The strap system 24 is preferably substantially identical in construction to the strap system 22, and is similarly installed on the arch assembly 28.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. An epaulet system for attachment to a shoulder pad, the system including an epaulet having an elongate epaulet projection extending outwardly therefrom, an epaulet restraining member mountable on the shoulder pad at a location spaced from the epaulet adjacent the epaulet projection and having an elongate channel for receiving the epaulet projection, a flexible connector positionable to extend between the epaulet and the shoulder pad for hingedly connecting the epaulet to the shoulder pad, and a force member for urging the epaulet toward the shoulder pad.

2. The system of claim 1, wherein the epaulet has a pair of spaced apart epaulet projections and the epaulet restraining member has a pair of channels for receiving the epaulet projections.

3. The system of claim 1, wherein the force member urges the epaulet in a direction to retain the projection in the channel.

4. The system of claim 3, wherein the force member comprises a strip of spring steel.

5. The system of claim 1, wherein the flexible connector comprises a flexible polymeric material.

6. The system of claim 1, wherein the epaulet projection is substantially rigid.

* * * * *